US007325261B2

(12) United States Patent
Bock

(10) Patent No.: US 7,325,261 B2
(45) Date of Patent: Feb. 5, 2008

(54) BED, ESPECIALLY SICK BED OR NURSING BED

(75) Inventor: Ernst Bock, Verl (DE)

(73) Assignee: Hermann Bock GmbH (DE)

( * ) Notice: Subject to any disclaimer, the term of this patent is extended or adjusted under 35 U.S.C. 154(b) by 630 days.

(21) Appl. No.: 10/466,663

(22) PCT Filed: Jan. 19, 2002

(86) PCT No.: PCT/EP02/00496

§ 371 (c)(1),
(2), (4) Date: Jan. 7, 2004

(87) PCT Pub. No.: WO02/056735

PCT Pub. Date: Jul. 25, 2002

(65) Prior Publication Data

US 2004/0111799 A1 Jun. 17, 2004

(30) Foreign Application Priority Data

Jan. 19, 2001 (EP) ..... 01101215

(51) Int. Cl.
*A47C 23/06* (2006.01)

(52) U.S. Cl. ..... 5/236.1; 5/247; 5/617

(58) Field of Classification Search ..... 5/239, 5/236.1, 247, 255, 618, 617
See application file for complete search history.

(56) References Cited

U.S. PATENT DOCUMENTS

| | | | | |
|---|---|---|---|---|
| 5,095,560 A | | 3/1992 | Volker | |
| 5,588,165 A | * | 12/1996 | Fromme | 5/247 |
| 6,477,727 B1 | * | 11/2002 | Fromme | 5/247 |

FOREIGN PATENT DOCUMENTS

| | | |
|---|---|---|
| DE | 25 24 727 | 12/1976 |
| DE | 38 02 163 | 8/1989 |
| DE | 44 16 689 | 6/1995 |
| DE | 295 05 052 | 5/1996 |
| DE | 195 47 206 | 3/1997 |
| EP | 0 433 737 | 11/1990 |
| FR | 2 336 119 | 7/1977 |
| GB | 2 259 446 | 3/1993 |

* cited by examiner

*Primary Examiner*—Alexander Grosz
(74) *Attorney, Agent, or Firm*—Cantor Colburn LLP

(57) ABSTRACT

A bed having a bed support and a bed fitting, the bed including: a bed frame, wherein the bed frame is equipped with at least one lying surface element and the lying surface element includes a plurality of spring elastic elements on a mattress side, wherein the spring elastic elements are arranged on the lying surface element in an interchangeable manner and the lying surface element is arranged on the bed frame in an interchangeable manner. The lying surface elements comprise ventilation recess having peripheral fluid retentation collars.

9 Claims, 4 Drawing Sheets

BED, ESPECIALLY SICK BED OR NURSING BED

FIELD OF THE INVENTION

The invention relates to a bed, particularly a sick and/or nursing bed.

DESCRIPTION OF THE RELATED ART

Beds of the above-mentioned kind are known from the prior art in many different designs and are used in practice among other things in the hospital and/or nursing field e.g. by hospitals, assisted living and nursing homes as well as for in-home use. Such beds serve the purpose of allowing the patient to assume a comfortable and especially adequate reclined or sitting position for the respective illness or required care. Therefore such sick and/or nursing beds generally comprise lifting devices for raising and lowering the bed fitting relative to the bed support as well as additional adjusting possibilities with regard to the bed frame.

A generic bed is revealed for example in DE 44 16 689. From this publication we know of a bed, especially a sick bed, which consists of a bed support and a bed fitting with bed frame, wherein said fitting is height adjustably guided in the bed support. For lifting and lowering the bed fitting in relation to the bed support, two driving motors that can be operated independent from each other are provided, which together with a horizontal control device displace the bed fitting in such a manner that even when adjusting the height a certain, in particular a horizontal position is always maintained.

Also DE 195 47 206 as well as EP 0 433 737, respectively, reveal a sick and/or nursing bed with a bed fitting as well as a bed support carrying the bed fitting. The bed frame and the bed fitting are coupled with each other by means of a corresponding lifting mechanism, wherein the bed fitting is displaceable in its height in relation to the bed support. So as not to be dependent upon additional operating staff, the height can be adjusted by means of a lifting device, which can be operated by the patient via remote control.

From DE 25 24 727 we know of a sick and/or nursing bed with a swiveling back and/or leg rest. To guarantee safe blocking of the swiveling rests in any position while simultaneously swiveling the back and/or leg rests easily and conveniently, the bed revealed here comprises a power memory in the form of an uncontrolled gas spring as well as a mechanical blocking device.

All above-described bed designs have the common feature that the sectional bed frame, which serves to enable an inclined and/or sitting position that is suitable for the respective illness or care, comprises one at least spring elastic lying surface element, which is held either by the bed frame or is designed in combination with it. One example for the design of a spring elastic lying surface element is the slatted frame. The mattress itself is then placed onto the slatted frame. Conventional slatted frames consist of individual slats, which are spaced in the longitudinal direction of the bed frame at a distance, are usually made of wood and are designed in part elastically to improve comfort. It is also known that instead of a slatted frame a type of elastic netted grid can be used, which is stretched in the bed frame and holds the mattress. Depending on the intended use and type, said elastic netted grid can be made of metal or polymer.

The use of both a slatted frame or a netted grid of the above-described kind offers the advantage that the spring comfort is not determined solely by the mattress, but rather the use of such mattress supports allows considerably improved lying comfort to be achieved.

However, contrary to the above-mentioned advantage, both the use of a slatted frame as well as the use of a net-like mattress support in part involves considerable disadvantages, particularly in the hospital and/or nursing bed field. For example, it happens frequently that bed-ridden patients unintentionally discharge bodily fluids, such as urine or the like, which then not only soak into the linen and mattress, but also come into contact with partial areas of the mattress support region, for example the slatted frame. Cleaning, particularly cleaning that satisfies all hygienic requirements from a medical point of view, is not only time-consuming, but can often additionally not be performed by the care taker alone. First the mattress has to be removed and the mattress support, e.g. the slatted frame, must be turned or set upright so that the bottom can be cleaned as well. One person cannot handle this alone. Then all components of the mattress support must be carefully cleaned. In a slatted frame this includes all slatted frame sections, wherein careful cleaning comprises both the side of each slatted frame facing upward as well as that facing downward. The same applies for net-like mattress supports. Here as well all individual components have to be subjected to a thorough cleaning process, wherein depending on the design of the grid-shaped mattress support these can be even more complex than compared to the cleaning required with a slatted frame.

In addition, quite a considerable disadvantage is the fact that conventional slatted frames are generally made of wood. Even if each individual slatted frame section were provided with a sealing layer, said layer will wear over time so that at least partial regions of the slatted frame come into contact with possibly discharged bodily fluids without protection. This is of extreme concern especially for hygienic reasons since even the most thorough surface cleaning cannot prevent the wood from absorbing fluid. The disadvantageous consequence is the generation and expansion of possibly health-damaging germs, bacteria and fungi.

In order to avoid the above-described disadvantages, the use of pan-like mattress supports is known from the prior art. These mattress supports in particular serve to effectively collect discharged fluids and prevent uncontrolled running of the fluid and/or uncontrolled contact of the fluid with other bed components. However, these previously known mattress supports are very time-consuming to keep hygienically clean. Above all, the use of such mattress supports limits lying comfort to such an extent that the use in the sick and/or nursing bed field, if at all, is possibly only with time restrictions. This is due on one hand to the lacking spring comfort since with the use of a mattress support that is made e.g. of metal all spring comfort, is solely created by the mattress itself, on the other hand, the required density of the mattress support extensive adjusting possibilities of the lying surface for adjustment of an inclined or sitting position that is adequate for the illness or care are not possible. To this end, the use of above-described mattress supports is in no way satisfactory.

SUMMARY OF THE INVENTION

It is therefore the object of the present invention to further develop a bed, especially a sick and/or care bed, while avoiding above-mentioned disadvantages in such a way that for one the highest demand for sufficient lying comfort is guaranteed as well as that secondly hygienic cleaning of contaminated bed components, especially in the case of unintended fluid losses, is possible in a simple and easily performed manner.

It is, therefore, suggested in the invention as a solution to the task that the spring elastic elements on the lying surface element and the lying surface element on the bed frame are arranged interchangeably.

This invented design for the first time comprises a bed design that offers the person lying in the bed sufficiently good lying comfort, which is important particularly with regard to the use of the invented bed as a sick and/or nursing bed, and that simultaneously makes it possible to keep the individual lying surface elements hygienically clean.

The bed frame is preferably comprised of bed frame sections that are arranged in a swiveling and displaceable manner relative to each other, wherein the individual bed frame sections are equipped with at least one lying surface element, respectively. For adaptation to individually controlled inclined and/or sitting comfort, lying surface elements of various designs can be combined with spring elastic elements, which differ with regard to their required properties, based on the modular concept.

As a consequence of the combined arrangement of lying surface element and spring elastic element, a lying and/or sitting comfort that satisfies the highest requirements is achieved, wherein individual requests can be taken into consideration as needed because the invented design offers the possibility to combine different lying surface elements with different spring elastic elements with each other based on the modular concept. For example, spring elastic elements that are adjusted to the patient's size or weight can be used so that no lying indentations or the like are created, as is the case for example with conventional slatted frames or net-like grids. Beyond that, the invented configuration of lying surface element and spring elastic element enables an inclined and/or sitting comfort to be created that is appropriate for the illness or care. The individual bed frame sections of the bed frame for example can be equipped with spring elastic elements of different properties so that, for example, in the head area of the patient a less elastic area is provided, while in the hip area spring elements with comparatively high elasticity are used. Contrary to conventional mattress supports, the combined use of lying surface elements and spring elastic element also makes it possible to create individual lying comfort for each patient and/or illness.

Both the lying surface elements and the spring elastic elements are arranged in an interchangeable manner. This creates not only the possibility of being able to individually design the lying comfort level, but the interchangeability of the various elements also ensures that hygienic cleaning is easy to perform since the elements that require cleaning can be easily removed and freed from contamination. With regard to the lying surface element material, especially a molded polymer or deep-drawn metal is preferred. Such lying surface elements are easy to handle due to their low inherent weight, enable thorough and above all hygienic cleaning and are substantially impervious against acidic and/or alkaline acting fluids. For the spring elastic element especially polymer has proven to be a suitable material. On the one hand because with the use of different types of polymers and different molding techniques a variety of different spring element shapes can be created, which also differ in terms of their spring elasticity properties, on the other hand the use of polymer is comparatively inexpensive so that overall manufacture is economical.

Each bed frame section of the bed frame is preferably equipped with a separate lying surface element. This design is especially advantageous for applications in the sick and/or nursing bed field. The individual bed frame sections can, for example, be displaced or swiveled relative to each other so that the bed frame as a whole forms a lying surface, which enables a comfortable inclined and/or sitting position, and above all one that is adequate for the illness or care for the patient in the bed. For this purpose, the individual bed frame sections are each equipped with a preferably single-piece lying surface element. These individual lying surface elements can beneficially be cleaned separately from each other. It is, therefore, not required for hygienic cleaning to clean the entire bed frame, rather it suffices to clean only those lying surface elements that require cleaning. If, for example, in the case of unintended fluid discharge, a loss of urine, blood or the like, only a single lying surface element is accordingly contaminated, while the remaining lying surface elements did not come into contact with the fluid, sufficient hygienic cleaning also in the medical sense is given if the contaminated lying surface element only is cleaned. The uncontaminated lying surface elements do not require cleaning. Contrary to the state of the art, this creates a considerably time and work advantage. Moreover, handling is improved considerably as well. This is beneficial particularly when considering that the cleaning process can now be performed by a single person.

Replacement of individual lying surface elements is also considerably easier than the complete replacement of an entire slatted frame or netted grid. Thus, the invented design makes it possible to remove individual lying surface elements and replace with exchangeable elements. Such a procedure is particularly beneficial when, for example, for a quick restoration and use of a contaminated bed, cleaning of the affected lying surface elements is not performed at the location, but in separate facilities. In this case the contaminated lying surface element or the contaminated lying surface elements can be easily removed from the respective bed frame section and be replaced with a hygienically flawlessly cleaned lying surface element and/or lying surface elements. The lying surface element or elements to be cleaned can then be cleaned separate from the bed, from which they have been removed, while the remaining bed is already being prepared again for use.

The aforementioned replacement of individual lying surface elements for the purpose of cleaning moreover offers the advantage that the lying surface elements that are to be cleaned do not have to be cleaned manually by the appropriate staff, but instead all lying surface elements that need cleaning throughout the hospital can be gathered in a central location and be cleaned while using an automatic cleaning system. This is beneficial not only from ecological point of view, but such a cleaning process is also more precise and requires comparatively fewer personnel.

The above-described lying surface elements, as already mentioned, comprise a plurality of individual spring elastic elements on the mattress support side, which ensures that the lying comfort is compensated not solely by the mattress, but that instead a lying surface area is created, which in accordance with the lying position or the weight of the patient in the bed creates an elastic compensation and thus offers the opportunity of a comfortable inclined and/or sitting position, which is above all adequate for the illness or care. The individual lying surface elements are connected with the appropriate spring elastic elements such that joint cleaning of both the lying surface elements and also the spring elastic elements is possible. To achieve hygienic cleaning, it is therefore not required to remove the spring elastic elements from the respective resting surface element.

Thus, the invented bed design overall provides a bed that is particularly suitable for the hospital and/or nursing care field, which due to the arrangement of spring elastic elements ensures that even the highest requirements in terms of sufficient lying comfort are met, but which at the same time also, as a consequence of the design of the individual lying surface elements, enables cleaning to be performed easily.

Pursuant to another feature of the invention, it is provided that the lying surface element contains at least one receiving area on the bed frame side, wherein for a torsion and/or displacement proof arrangement of the lying surface element said area in the assembled state of the bed accommodates correspondingly designed partial regions of the respective bed frame section. This beneficial design of the invention enables a fast assembly and disassembly of the lying surface elements. They can be removed easily from the respective bed frame section and also be re-inserted, wherein the receiving areas designed on the bed frame side, into which correspondingly designed partial regions of the respective bed frame section extend, ensure that the unintended rotation or displacement of the lying surface element is prevented. Pursuant to one design, the respective bed frame section can comprise, for example, upwardly aligned studs, which protrude into borings incorporated in the lying surface element. Alternatively, the lying surface element can also comprise receiving areas, which are designed to correspond to the profile parts forming the bed frame section, so that the lying surface element can be introduced into the respective bed frame section as a kind of insert. This also beneficially achieves a torsion and/or displacement proof arrangement of the lying surface element. Basically, gravity suffices for safely arranging an appropriate lying surface element in the respective bed frame section, however, for additional securing of the respective lying surface element further locking mechanisms can be provided.

Additional fastening devices, such as screws, locking pins or fast snap-fit closures, are particularly suited for this. For each individual bed frame section preferably one lying surface element is provided so that the number of bed frame section available overall is equal to the number of lying surface elements that are used. Each individual lying surface element can be arranged on the respective bed frame section and can be removed independent from the other lying surface elements and be replaced with a different lying surface element. Especially with regard to the hygienic cleaning of the lying surface element this is beneficial because it enables fast replacement of the individual lying surface elements so that a contaminated lying surface element can be removed and be exchanged with a hygienically flawless lying surface element. The removed lying surface element can then be subjected to an appropriate cleaning procedure.

Pursuant to an additional feature of the invention, the lying surface element is designed substantially plate-shaped. Such a designed lying surface element can be handled easily by the staff. In terms of a fast connection, such a lying surface element can be equipped on its respective ends with additional fast snap-fit closures, which engage corresponding recesses on the respective bed frame section. This way a very uncomplicated replacement of lying surface elements is possible, which also requires only one staff member. For improved handling, the lying surface element contains moreover a handle.

Depending on the design of the bed frame, several bed frame sections that can be adjusted in their position independently from each other, can be provided. Three or four bed frame sections for example are common, wherein in the case of three bed frame sections one bed frame section is provided for the head area, one bed frame section for the foot area and one bed frame section for the middle area between the head and foot areas. One lying surface element, respectively, is provided for each individual bed frame section. In order to avoid confusion e.g. between head and foot lying surface elements during replacement, the individual lying surface elements can comprise appropriate markings, which make it impossible that a lying surface element that is designed for the foot area is accidentally installed in the head area of the bed frame.

Pursuant to another feature of the invention it is provided that the lying surface element comprise reinforcement and/or stiffening ribs. This configuration is of benefit especially with large-surface lying surface elements since this way additional stabilization and hence also improved lying comfort is achieved.

Pursuant to an additional feature of the invention the lying surface element contains a peripheral sidewall. For one, this creates a lateral fixation of a mattress placed onto the lying surface elements, on the other hand such a designed lying surface element offers improved fluid collection depending on the incline of the position so that compared to a substantially plate-shaped lying surface element a larger amount of fluid can be accommodated.

Pursuant to another feature of the invention the lying surface element comprises ventilation recesses for ingoing and outgoing air. The design of such recesses is advantageous especially with regard to ventilation of the mattress that is placed on top. Unnecessarily frequent transfers of the patient to another bed as a consequence of repeated mattress exchanges can hereby be avoided.

Pursuant to another feature of the invention, it is provided that several recesses are arranged next to each other so as to form a row, wherein in the longitudinal direction of the lying surfaces, elements of each row of recesses are allocated a receiving area for receiving the spring elastic elements. This invented design on one hand ensures secure positioning of the mattress, on the other hand ventilation of the mattress is guaranteed. The spring elastic elements arranged between the lying surface elements and mattress ensure that the mattress is arranged at a distance from the respective lying surface element.

Hence, an air gap develops between the mattress and lying surface elements. Said air gap is in direct contact with the ambient air of the bed via the ventilation recesses that are incorporated in the lying surface elements. Thus, a permanent air exchange between the ambient air and the air between the lying surface elements and mattress is guaranteed. This voluminous, constant ventilation affects the mattress bottom in an advantageous manner.

Pursuant to another feature of the invention it is provided that the through-holes forming the ventilation recesses comprise a fluid retention collar. Said collar effects on the one hand a stabilization of the lying surface elements, on the other hand the incorporation of such a collar ensures that unintended discharged fluids, which come into contact with the lying surface elements, do not unintentionally exit through the ventilation recesses and drip onto the floor beneath the bed. The retention collar rather ensures that fluids collect like in a type of trough and can be disposed of completely and in their entirety when cleaning the lying surface elements. Especially for hygienic reasons this design represents an improvement over the prior art.

Pursuant to an additional feature of the invention, the receiving area comprises a plurality of spring elastic elements, which are arranged next to one another in a row. This design results overall in a symmetrical configuration of the individual spring elastic elements so that in total a symmetrically acting spring comfort, i.e. lying comfort, is guaranteed. Depending on the selection of the individual spring elastic elements and/or depending on the number of elements used, a lying comfort level that is adapted to various desires can be achieved.

Pursuant to another feature of the invention it is provided both that the lying surface elements can be arranged by means of corresponding fast closures on the respective bed frame sections and that also the individual spring elastic elements preferably can be quickly detached from the respective lying surface element. This enables for one quick disassembly, for example for cleaning purpose, as well as the possibility of a combined use of different spring elastic elements together with a common lying surface element, which affords the opportunity to create individual lying comfort.

Based on another suggestion of the invention the lying surface element is equipped with a plurality of elastic spring elements, wherein several spring elements are arranged next to each other in the longitudinal direction and/or transverse direction of the lying surface element to form a common row. This measure as well accomplishes overall a symmetrically acting spring comfort, which ensures an accordingly beneficial level of lying comfort. Depending on the individual user specifications, individual spring element rows can consist of different spring elements, which differ for example in terms of their spring stiffness. This way a lying comfort level that can be adjusted very precisely can be implemented.

Alternatively to an individual configuration of various spring elements, especially in connection with the use of a lying surface element designed with side walls, the use of spring elements can be provided for, which pursuant to another beneficial suggestion of the invention are designed in a mat like combination with each other. Hence it is suggested to combine several spring elements with each other into mat like layers. These can then be placed onto the respective lying surface element. Especially in connection with lying surface elements containing sidewalls, the use of mat like spring elements is suited because they are safely secured by the sidewalls. Unintended sliding of the individual spring elements is thus effectively prevented. At the same time, however, it is also possible to combine the use of spring elements that have been combined with each other to form mat like supports with a plate-shaped lying surface element. In this case, however, the spring elements should be combined at least in some areas of the mat with the lying surface element by means of additional fastening elements. The advantage of combining several spring elastic elements into a mat like insert with each other is essentially based on the quicker replacement. Contrary to a fastening of each individual element, the use of mat like combined spring elements does not require each individual spring element to be attached separately on the respective lying surface element; it is rather sufficient to attach the mat like support as such. A sole fastening point is generally sufficient.

Pursuant to an additional beneficial suggestion of the invention, it is provided that the spring elastic element is designed like a leaf spring and comprises a connecting area, a support area as well as a spring element area coupling the connecting area with the support area. The connecting area serves the fastening of the leaf spring on the respective lying surface element. For this purpose it can be provided for example that the connecting area contains a receiving feature in the form of a through-hole, through which a fastening device, for example a screw, can be guided for the purpose of attachment to the respective lying surface element and can be screwed in. It is equally feasible that the connecting area comprises fast snap-fit elements, which are inserted into corresponding recesses or placed onto corresponding projections. The support area of the leaf spring serves the accommodation of the mattress that is to be inserted into the bed. By arranging a plurality of leaf springs, an extensive support area is developed, which receives the inserted mattress over the entire surface. Between the connecting area and the support area a spring element area is incorporated. Said spring element area causes the support area to move in a spring-elastic manner relative to the connecting area, which in the end implements the spring-elastic accommodation of the mattress. The spring element area is preferably formed by at least one spring device, which exhibits a specified spring stiffness. Other types of designs of the spring elastic element are also feasible, for example the connecting area, the spring element area and the support area can be designed as one piece; the sole decisive factor is that the spring elastic element enables a spring elastic configuration of the mattress on the lying surface elements. Only by arranging spring elastic elements between the mattress and the respective lying surface elements is it possible to achieve improved lying comfort, which is not caused by the spring elasticity of the mattress itself. Additionally, as described above, this type of arrangement of a plurality of different spring elements offers the opportunity of adjusting the individual lying comfort level.

Pursuant to another feature of the invention, the spring element area consists of several substantially elongated spring devices, which are arranged in a star shape. This type of configuration in particular creates a lying comfort that is adequate for the respective illness and/or care.

Pursuant to an additional feature of the invention, several spring elastic elements of equal and/or differing spring stiffness levels can be combined with each other as needed based on the modular concept and be connected with the lying surface element. This creates the already addressed individualization of the lying comfort level, wherein especially with regard to the modular concept a combination of various different elements with each other is possible.

The spring elastic elements preferably consist of a polymer that is impervious towards acidic or alkaline acting fluids. For one this enables hygienic cleaning, and secondly with the use of appropriate molding techniques polymer elements can be produced that satisfy the aforementioned requirements completely.

BRIEF DESCRIPTION OF THE DRAWINGS

Further advantages and features of the invention result from the description based on the following figures. They show.

DETAILED DESCRIPTION

Figure 1:
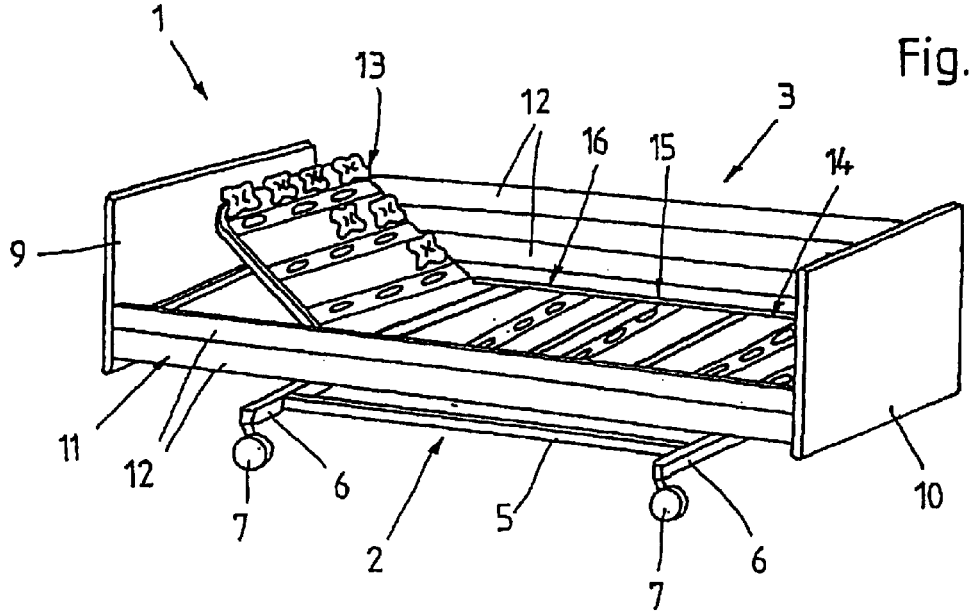
FIG. 1 in a diagrammatic depiction a first design of the invented bed.
Figure 2:
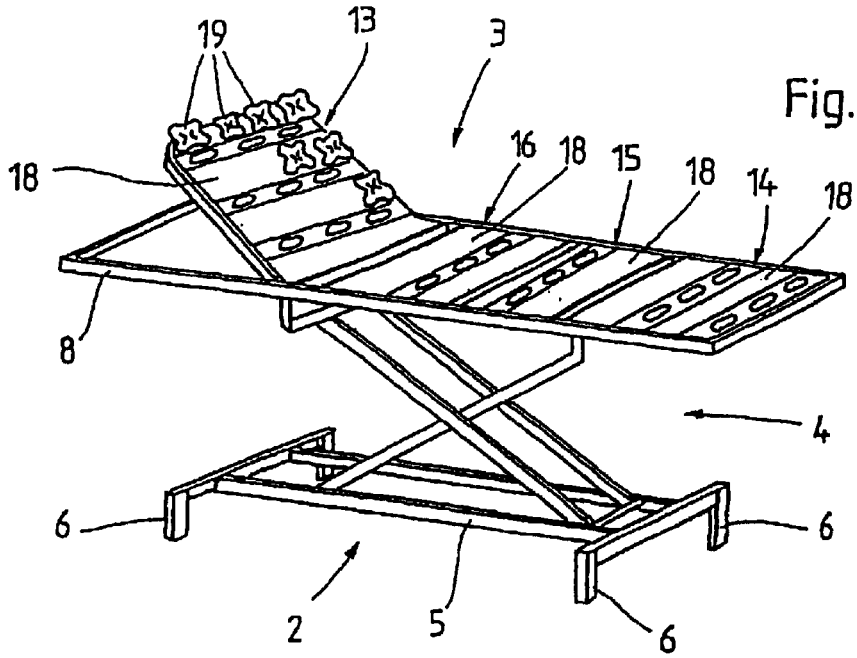
FIG. 2 in a diagrammatic depiction the first design of the invented bed pursuant to FIG. 1, however without paneling components.

FIG. 1 shows a diagrammatic depiction of an invented bed 1. Said bed consists of a bed support 2 as well as a bed fitting 3. The bed support 2 and bed fitting 3 are coupled with each other by means of a height adjustment device 4 (see FIG. 2). With the height adjustment device 4, the bed fitting 3 can be displaced relative to the bed support in terms of its height. In detail, the height adjustment device 4 consists of lifting devices as well as driving devices, which are not shown in this figure. In order to enable the patient lying in bed to adjust the height of the bed fitting 3 without help from a staff member, the height adjustment device 4 can be operated by remote control. The height adjustment device 4 hereby enables not only a parallel displacement of the bed fitting 3 in relation to the ground, but also adjustment at an angle of inclination so that the bed fitting 3 can select any random position within the lifting limits of the height adjustment device 4.

The bed support 2 consists of a bed support frame 5 as well as support legs 6, which are possibly designed as extensions. The bed support frame 5 as well as the support legs 6 are designed such that the permissible overall weight is at least 200 kg, which can be equated to the fact that the permissible patient weight is at least 130 to 140 kg. On the bottom the bed support frame 5 contains a total of four support rollers 7. Said support rollers 7 are formed by foot rollers, which are seated displaceably both about their transverse and their vertical axes and permit displacement without great force as well as good maneuverability of the bed.

The bed fitting 3 consists preferably of a bed frame 8 as well as the side sections delimiting the lying surface. A front part 9, a rear part 10 as well as a side part 11 for each longitudinal side of the bed are provided as well. The side parts 11 can be set up in a preferred design like railings and be formed by at least two wales 12 that are arranged on top of each other. Pursuant to a preferred design, the wales 12 are arranged detachably at least on one longitudinal side of the bed so that the wales can be removed from their supports at least part of the time for getting in and out of the bed.

The bed frame 8 consists of several bed frame sections as well as an adjusting device. This is shown the best in FIG. 2. The bed frame preferably comprises a total of four bed frame sections. These are divided into a head bed frame section 13, a foot bed frame section 14, a thigh bed frame section 15 as well as a center bed frame section 16. The individual bed frame sections are arranged such that they can be swiveled and displaced relatively to one another. This is implemented with the adjusting device 17, which connects the individual bed frame sections with each other. The adjusting device 17 is preferably designed as a bar assembly and can be operated from the outside by appropriate levers.

Each of the aforementioned bed frame sections 13, 14, 15 or 16 is equipped with a lying surface element 18. The lying surface element 18 preferably consists of molded resin and exhibits essentially the shape of a plate. The lying surface element 18 serves the accommodation of a plurality of spring elastic elements 19, which in turn accommodate the mattress, which is not shown in the figure. This connection is best revealed in FIG. 3.

The lying surface elements 18 each comprise recesses 20, which serve the ventilation of the mattress supported by the spring elements 19.

Figure 3:
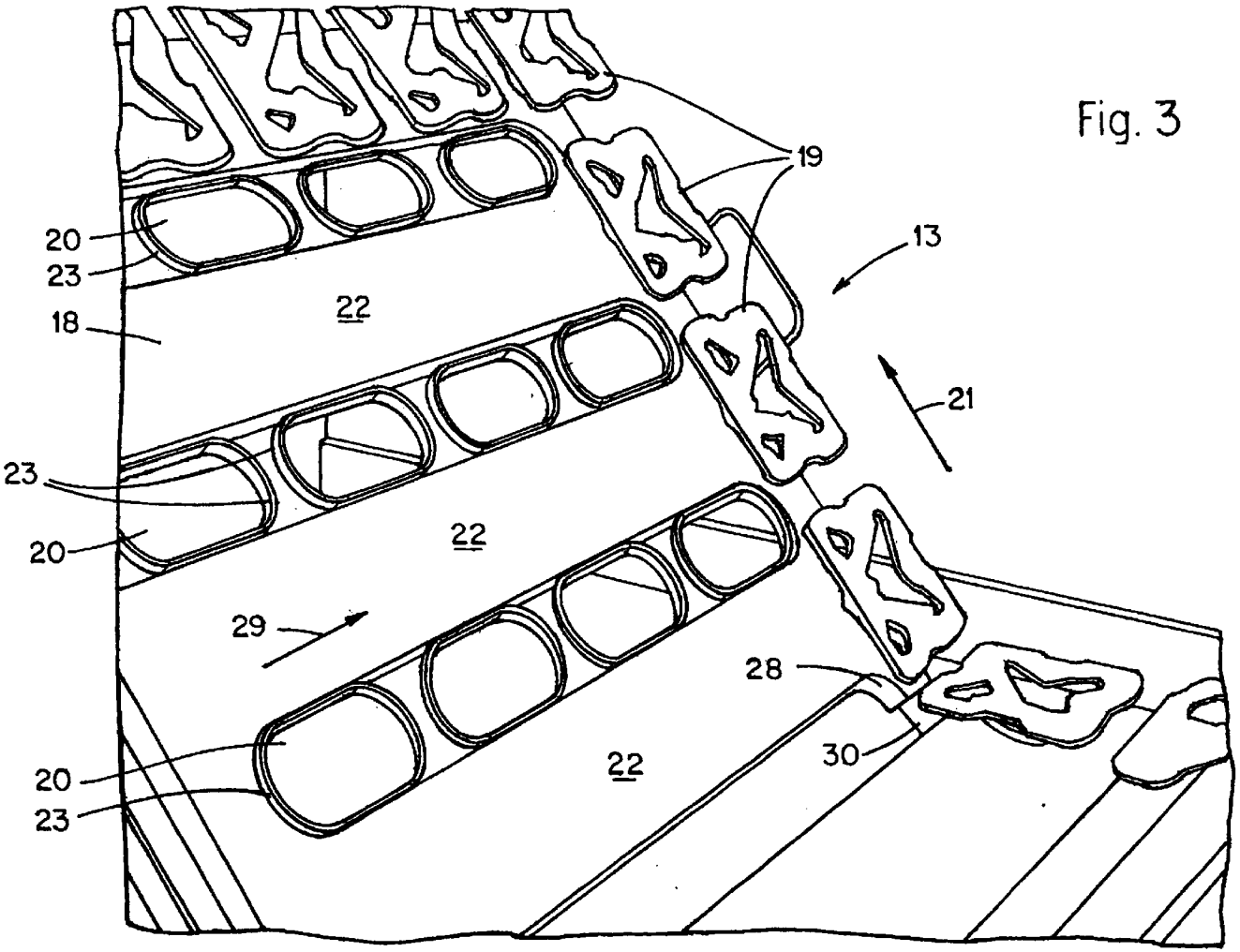
FIG. 3 in a diagrammatic depiction a first partial section of the bed frame of the invented bed.
Figure 4:
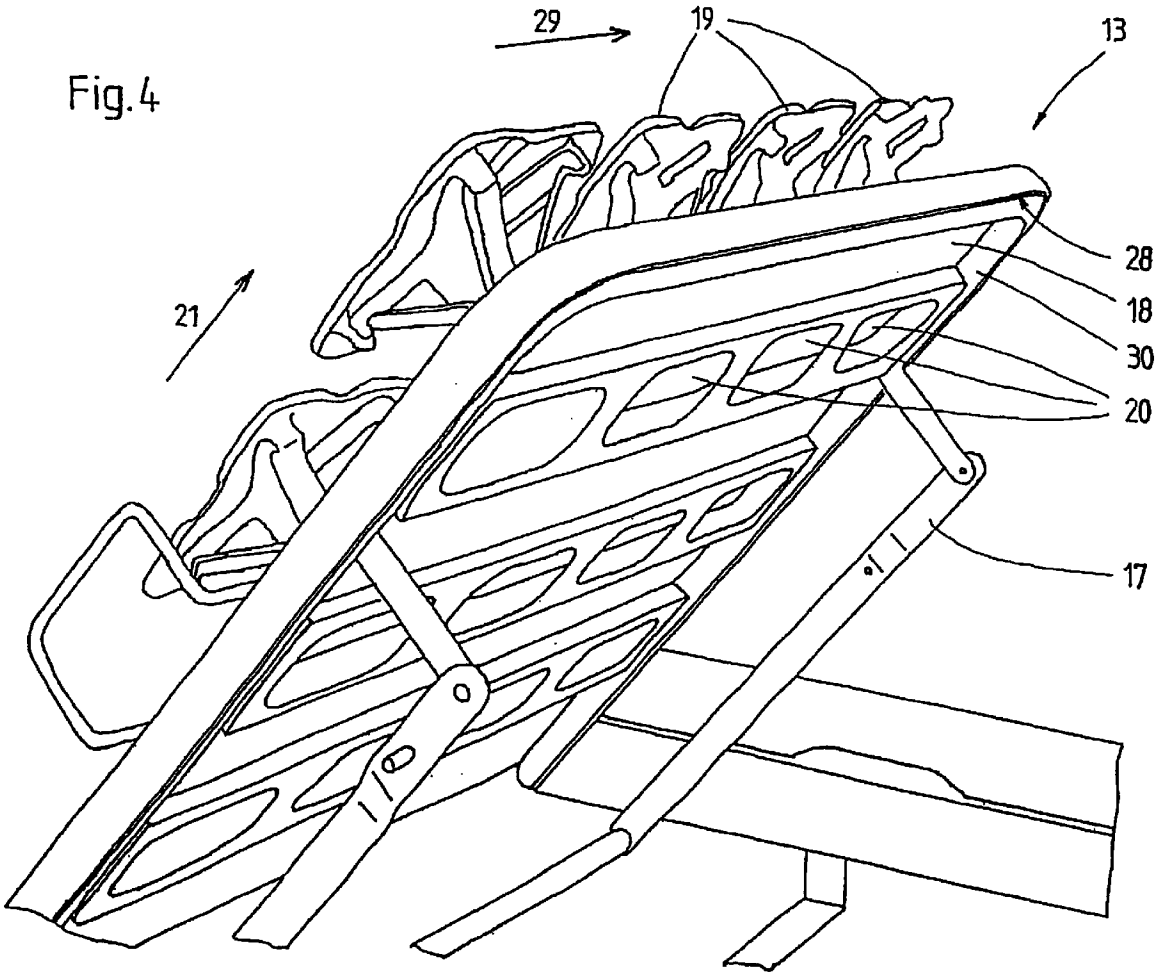
FIG. 4 in a diagrammatic depiction a second partial section of the bed frame of the invented bed.

As especially FIGS. 3 and 4 show, several ventilation recesses 20 are arranged next to each other to form a row, wherein in the longitudinal direction 21 of the lying surface element 18 of each row of recesses 20 a receiving area 22 for accommodating the spring elastic elements 19 is arranged before and after. This creates rows that are arranged transverse to the longitudinal direction 21 of the lying surface element 18, wherein rows with spring elements 19 and rows with ventilation recesses 20 are provided alternately. Pursuant to another design, it can be provided that several recesses 20 of one row are combined into an overall recess. Independent of the fact whether individual recesses 20 or one overall recess are provided, the recesses preferably contain a peripheral fluid retention collar 23. Said retention collar 23 serves the purpose of retaining fluids that distribute on the lying surface element 18 such that they do not drip through the recesses 20 onto the floor.

For a torsion and displacement proof arrangement of the lying surface element 18, said element contains on the bed frame side a receiving area 28, which accommodates correspondingly designed partial regions of the respective bed frame section. In the design shown in FIG. 4, these corresponding partial regions are the profile parts 30 that limit the bed frame sections. The lying surface element 18 is designed such that on the bed frame side a receiving area 28 is provided, into which the profile parts 30 of the respective bed frame section extend in a form-fitting manner. For a satisfactory assembly of the bed it is therefore sufficient to place the lying surface element 18 onto the bed frame section in such a way that the profile parts 30 rest within the receiving area 28. The weight of the lying surface element 18 is sufficient to ensure a secure arrangement of the lying surface element 18. Arranging the profile parts 30 within the receiving area 28 that is incorporated on the lying surface element 18 additionally ensures a torsion and displacement proof configuration of the lying surface element 18. To additionally fix the position of the lying surface element 18, further safety measures can be provided, such as additional fastening devices, which fixate the lying surface element 18 on the profile parts 30 of the bed frame section. For this especially screws, studs, including locking pins, as well as fast snap-fit closures are suited.

Figure 5:
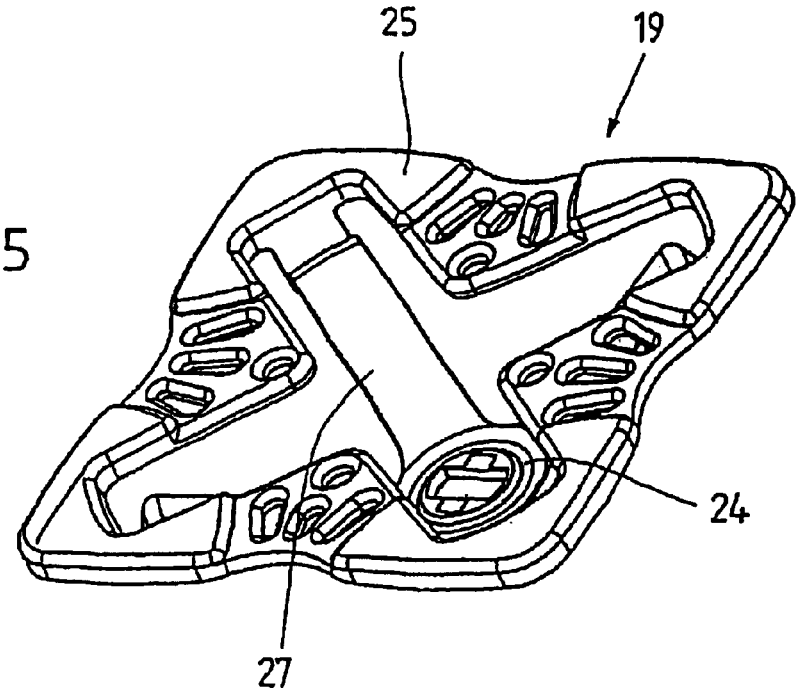
FIG. 5 in a diagrammatic depiction a spring elastic element in the shape of a leaf spring.

In the preferred design shown in FIG. 5, the spring elastic elements 19 are designed like a leaf spring and comprise a connecting area 24, a support area 25 as well as a spring element area 26 that couples the connecting area 24 with the support area 25. The connecting area 24 serves the detachable arrangement of the individual leaf springs on the respective lying surface element 18. For this, appropriate fastening devices, such as screws, rivets or clip elements, can be employed. The support area 25 of the spring elements 19 serves the accommodation of the mattress, which is not shown in the Figures. If, as shown in the Figures, a plurality of spring elements 19 is arranged based on the modular concept both in the longitudinal direction 21 as well as in the transverse direction 29 of the lying surface element 18 so as to form rows, a plane mattress support is created.

Figure 6:
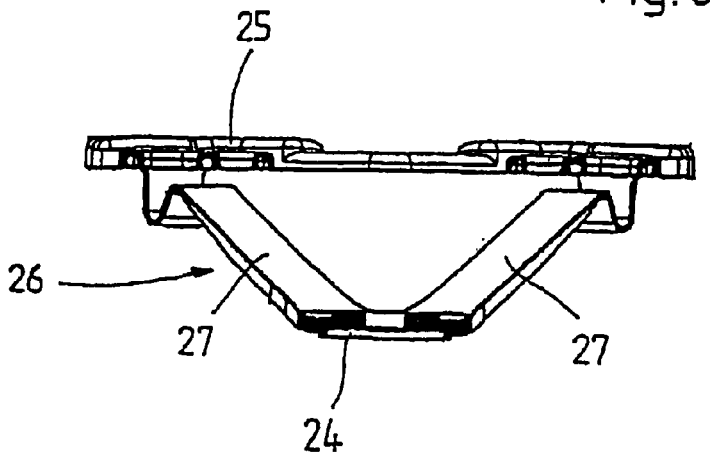
FIG. 6 in a diagrammatic side view a spring elastic element in the shape of a leaf spring.

The support area 25 and the connecting area 24 of the spring element 19 are coupled with each other via the spring element area 26. This creates a spring elastic accommodation of the support areas 25, which in the end serves to adjust the lying comfort level as appropriate for the illness and/or care. This is revealed in particular in FIG. 6. The spring element area 26 consists of several essentially elongated spring devices 27, which are arranged in a star-shaped manner. Said spring devices 27 can exhibit different levels of spring stiffness so that not only spring elements 19 with the different spring stiffness levels can be combined individually with each other, but also that it offers the possibility of adjusting a spring element 19 in terms of its spring stiffness exactly such that it differentiates between a "left" tilt and a "right" tilt in terms of spring properties. This way, for example, a resilience comfort pointing away from inside the bed can be adjusted so that the formation of an "indentation" can be counteracted. Contrary to conventional lying surface elements, such as the slatted frame e.g., the use of the aforementioned spring elements 19 enables point-specific and hence also point-adjustable spring comfort. Contrary to conventional slatted frames, this provides a considerably improved adjusting possibility in terms of lying and sitting comfort. This is expanded additionally through the fact that, as mentioned above, not only different spring elements 19 can be combined with one and the same lying surface element, but also that the individual spring devices 27 can take on different designs within the spring element 19.

Pursuant to an alternative design, several spring elements 19 can be combined with each other as a mat like configuration. Such a spring mat can then be arranged in the same manner on the respective lying surface element 18 as individual spring elements 19 are arranged. However in this case, it is no longer required to attach each spring element 19 on its own to the respective lying surface element 18. The attachment of the spring element mat as such is sufficient, which securely attaches all spring elements comprising the spring element mat to the respective lying surface element 18. The use of a spring element mats is especially beneficial when the lying surface element 18 is designed like a lying surface element containing sidewalls, which have a supporting effect. Said side walls then prevent the spring element mats from sliding so that a separate attachment to the respective lying surface element 18 can be foregone.

Legend

1 Bed
2 Bed Support
3 Bed Fitting
4 Height Adjustment Device
5 Bed Support Frame
6 Support Leg
7 Support Roller
8 Bed Frame
9 Front Part
10 Rear Part
11 Side Part
12 Wale
13 Head Bed Frame Section
14 Foot Bed Frame Section
15 Thigh Bed Frame Section
16 Center Bed Frame Section
17 Adjusting Device
18 Lying Surface Element
19 Spring Element
20 Recess
21 Longitudinal Direction
22 Receiving Area
23 Retention Collar
24 Connecting Area
25 Support Area
26 Spring Element Area
27 Spring Device
28 Receiving Area
29 Transverse Device
30 Profile Parts

What is claimed is:

1. Bed having a bed support and a bed fitting, the bed comprising: a bed frame, wherein the bed frame is equipped with at least one lying surface element and the lying surface element comprises a plurality of spring elastic elements on a mattress supporting side, wherein the spring elastic elements are arranged on the lying surface element in an interchangeable manner and the lying surface element is arranged on the bed frame in an interchangeable manner;

wherein the lying surface element comprises ventilation recesses;

wherein the recesses comprise a peripheral fluid retention collar on the mattress support side.

2. Bed pursuant to claim 1, wherein the lying surface element comprises on a bed frame side at least one receiving area, which in an assembled state of the bed accommodates correspondingly designed partial regions of a respective bed frame section for torsion and/or displacement proof arrangement of the lying surface element on the respective bed frame section.

3. Bed pursuant to claim 2, wherein for each bed frame section one lying surface element is provided, respectively.

4. Bed pursuant to claim 1, wherein the lying surface element is designed substantially plate-shaped.

5. Bed pursuant to claim 4, wherein the lying surface element comprises a peripheral sidewall.

6. Bed pursuant to claim 1, wherein the recesses can be closed with appropriate inserts on the mattress side.

7. Bed pursuant to claim 1, wherein the lying surface element is equipped with a plurality of elastic spring elements, wherein several spring elements are arranged next to each other in the longitudinal direction and/or transverse direction of the lying surface element so as to form a common row.

8. Bed pursuant to claim 1, wherein several spring elements are combined with each other in a mat like manner.

9. Bed pursuant to claim 1, wherein at least one lying surface element and the spring elastic elements are made of polymer and/or metal.

* * * * *